US006750820B2

(12) United States Patent
Killen et al.

(10) Patent No.: US 6,750,820 B2
(45) Date of Patent: Jun. 15, 2004

(54) HIGH EFFICIENCY ANTENNAS OF REDUCED SIZE ON DIELECTRIC SUBSTRATE

(75) Inventors: William D. Killen, Melbourne, FL (US); Randy T. Pike, Grant, FL (US)

(73) Assignee: Harris Corporation, Melbourne, FL (US)

( * ) Notice: Subject to any disclaimer, the term of this patent is extended or adjusted under 35 U.S.C. 154(b) by 4 days.

(21) Appl. No.: 10/184,277

(22) Filed: Jun. 27, 2002

(65) Prior Publication Data

US 2004/0001026 A1 Jan. 1, 2004

(51) Int. Cl.[7] ..... H01Q 1/38

(52) U.S. Cl. ..... 343/700 MS; 343/795

(58) Field of Search ..... 343/700 MS, 795, 343/866, 741

(56) References Cited

U.S. PATENT DOCUMENTS

| | | | | |
|---|---|---|---|---|
| 3,571,722 A | | 3/1971 | Vendelin | 325/445 |
| 3,678,418 A | | 7/1972 | Woodward | 333/26 |
| 4,495,505 A | | 1/1985 | Shields | 343/821 |
| 4,525,720 A | | 6/1985 | Corzine et al. | 343/895 |
| 4,800,344 A | | 1/1989 | Graham | 333/25 |
| 4,825,220 A | | 4/1989 | Edward et al. | 343/795 |
| 4,882,553 A | | 11/1989 | Davies et al. | 333/26 |
| 4,916,410 A | | 4/1990 | Littlefield | 330/295 |
| 4,924,236 A | | 5/1990 | Schuss et al. | 343/700 MS |
| 5,039,891 A | | 8/1991 | Wen et al. | 307/529 |
| 5,148,130 A | | 9/1992 | Dietrich | 333/25 |
| 5,155,493 A | * | 10/1992 | Thursby et al. | 343/700 MS |
| 5,379,006 A | | 1/1995 | McCorkle | 333/26 |
| 5,455,545 A | | 10/1995 | Garcia | 333/26 |
| 5,523,728 A | | 6/1996 | McCorkle | 333/128 |
| 5,563,616 A | * | 10/1996 | Dempsey et al. | 343/700 MS |
| 5,678,219 A | | 10/1997 | Agarwal et al. | 455/280 |
| 5,870,057 A | * | 2/1999 | Evans et al. | 343/700 MS |
| 6,052,039 A | | 4/2000 | Chiou et al. | 333/100 |
| 6,114,940 A | | 9/2000 | Kakinuma et al. | 336/233 |
| 6,133,806 A | | 10/2000 | Sheen | 333/26 |
| 6,137,376 A | | 10/2000 | Imbornone et al. | 333/25 |
| 6,184,845 B1 | | 2/2001 | Leisten et al. | 343/895 |
| 6,307,509 B1 | | 10/2001 | Krantz | 343/700 MS |
| 6,353,443 B1 | * | 3/2002 | Ying | 343/702 |

OTHER PUBLICATIONS

U.S. patent application Ser. No. 10/448,973, Delgado et al., filed May 30, 2003.
U.S. patent application Ser. No. 10/185,443, Killen et al., filed Jun. 27, 2002.
U.S. patent application Ser. No. 10/184,332, Killen et al., filed Jun. 27, 2002.
U.S. patent application Ser. No. 10/185,251, Parsche et al., filed Jun. 27, 2002.
U.S. patent application Ser. No. 10/185,847, Killen et al., filed Jun. 27, 2002.
U.S. patent application Ser. No. 10/185,275, Killen et al., filed Jun. 27, 2002.
U.S. patent application Ser. No. 10/185,273, Killen et al., filed Jun. 27, 2002.
U.S. patent application Ser. No. 10/308,500, Killen et al., filed Dec. 3, 2002.

(List continued on next page.)

*Primary Examiner*—Hoang V. Nguyen
(74) *Attorney, Agent, or Firm*—Sacco & Associates, PA

(57) ABSTRACT

An antenna formed on a dielectric substrate including at least a first and second dielectric substrate region. One or more antenna-radiating element is formed on the first region of the dielectric substrate and defines a conductive path. Feed circuitry for the antenna can be formed on the second region of the dielectric substrate. The feed circuitry can comprise a balun, an impedance transformer, and/or a feed line. The dielectric substrate in the first region can preferably have a first relative permeability and/or first permittivity different from a second relative permeability and/or a second permittivity of the dielectric substrate of the second region.

25 Claims, 4 Drawing Sheets

OTHER PUBLICATIONS

U.S. patent application Ser. No. 10/373,935, Killen et al., filed Feb. 25, 2003.
U.S. patent application Ser. No. 10/404,285, Killen et al., filed Mar. 31, 2003.
U.S. patent application Ser. No. 10/404,981, Killen et al., filed Mar. 31, 2003.
U.S. patent application Ser. No. 10/404,960, Killen et al., filed Mar. 31, 2003.
U.S. patent application Ser. No. 10/185,144, Killen et al., filed Jun. 27, 2002.
U.S. patent application Ser. No. 10/185,266, Killen et al., filed Jun. 27, 2002.
U.S. patent application Ser. No. 10/185,162, Rumpf Jr., et al., filed Jun. 27, 2002.
U.S. patent application Ser. No. 10/185,824, Killen et al., filed Jun. 27, 2002.
U.S. patent application Ser. No. 10/185,187, Killen et al., filed Jun. 27, 2002.
U.S. patent application Ser. No. 10/185,855, Killen et al., filed Jun. 27, 2002.
U.S. patent application Ser. No. 10/185,459, Killen et al., filed Jun. 27, 2002.
U.S. patent application Ser. No. 10/185,480, Killen et al., filed Jun. 27, 2002.
U.S. patent application Ser. No. 10/439,094, Delgado et al., filed May 15, 2003.

* cited by examiner

HIGH EFFICIENCY ANTENNAS OF REDUCED SIZE ON DIELECTRIC SUBSTRATE

BACKGROUND OF THE INVENTION

1. Statement of the Technical Field

The inventive arrangements relate generally to methods and apparatus for providing increased design flexibility for RF circuits, and more particularly for optimization of dielectric circuit board materials for improved performance.

2. Description of the Related Art

RF circuits, transmission lines and antenna elements are commonly manufactured on specially designed substrate boards. For the purposes of these types of circuits, it is important to maintain careful control over impedance characteristics. If the impedance of different parts of the circuit do not match, this can result in inefficient power transfer, unnecessary heating of components, and other problems. Electrical length of transmission lines and radiators in these circuits can also be a critical design factor.

Two critical factors affecting the performance of a substrate material are dielectric constant (sometimes called the relative permittivity or $\in_r$) and the loss tangent (sometimes referred to as the dissipation factor). The relative permittivity determines the speed of the signal in the substrate material, and therefore the electrical length of transmission lines and other components implemented on the substrate. The loss tangent determines the amount of loss that occurs for signals traversing the substrate material. Losses tend to increase with increases in frequency. Accordingly, low loss materials become even more important with increasing frequency, particularly when designing receiver front ends and low noise amplifier circuits.

Printed transmission lines, passive circuits and radiating elements used in RF circuits are typically formed in one of three ways. One configuration known as microstrip, places the signal line on a board surface and provides a second conductive layer, commonly referred to as a ground plane. A second type of configuration known as buried microstrip is similar except that the signal line is covered with a dielectric substrate material. In a third configuration known as stripline, the signal line is sandwiched between two electrically conductive (ground) planes. In general, the characteristic impedance of a parallel plate transmission line, such as stripline or microstrip, is equal to $\sqrt{L_l/C_l}$ where $L_l$ is the inductance per unit length and $C_l$ is the capacitance per unit length. The values of $L_l$ and $C_l$ are generally determined by the physical geometry and spacing of the line structure as well as the permittivity of the dielectric material(s) used to separate the transmission line structures. Conventional substrate materials typically have a permeability of 1.

In conventional RF design, a substrate material is selected that has a relative permittivity value suitable for the design. Once the substrate material is selected, the line characteristic impedance value is exclusively adjusted by controlling the line geometry and physical structure.

Radio frequency (RF) circuits are typically embodied in hybrid circuits in which a plurality of active and passive circuit components are mounted and connected together on a surface of an electrically insulating board substrate such as a ceramic substrate. The various components are generally interconnected by printed metallic conductors of copper, gold, or tantalum, for example that are transmission lines as stripline or microstrip or twin-line structures.

The dielectric constant of the chosen substrate material for a transmission line, passive RF device, or radiating element determines the physical wavelength of RF energy at a given frequency for that line structure. One problem encountered when designing microelectronic RF circuitry is the selection of a dielectric board substrate material that is optimized for all of the various passive components, radiating elements and transmission line circuits to be formed on the board. In particular, the geometry of certain circuit elements may be physically large or miniaturized due to the unique electrical or impedance characteristics required for such elements. For example, many circuit elements or tuned circuits may need to be an electrical ¼ wave. Similarly, the line widths required for exceptionally high or low characteristic impedance values can, in many instances, be too narrow or too wide for practical implementation for a given substrate. Since the physical size of the microstrip or stripline is inversely related to the relative permittivity of the dielectric material, the dimensions of a transmission line can be affected greatly by the choice of substrate board material.

Still, an optimal board substrate material design choice for some components may be inconsistent with the optimal board substrate material for other components, such as antenna elements. Moreover, some design objectives for a circuit component may be inconsistent with one another. For example, it may be desirable to reduce the size of an antenna element. This could be accomplished by selecting a board material with a relatively high permittivity. However, the use of a dielectric with a higher relative permittivity will generally have the undesired effect of reducing the radiation efficiency of the antenna.

An antenna design goal is frequently to effectively reduce the size of the antenna without too great a reduction in radiation efficiency. One method of reducing antena size is through capacitive loading, such as through use of a high dielectric constant substrate for the dipole array elements.

For example, if dipole arms are capacitively loaded by placing them on "high" dielectric constant board substrate portions, the dipole arms can be shortened relative to the arm lengths which would otherwise be needed using a lower dielectric constant substrate. This effect results because the electrical field in high dielectric substrate portion between the arm portion and the ground plane will be concentrated into a smaller dielectric substrate volume.

However, the radiation efficiency, being the frequency dependent ratio of the power radiated by the antenna to the total power supplied to the antenna will be reduced primarily due to the shorter dipole arm length. A shorter arm length reduces the radiation resistance, which is approximately equal to the square of the arm length for a "short" (less the ½ wavelength) dipole antenna as shown below:

$$R_r = 20\pi^2(l/\lambda)^2$$

where l is the electrical length of the antenna line and $\lambda$ is the wavelength of interest.

A conductive trace comprising a single short dipole can be modeled as an open transmission line having series connected radiation resistance, an inductor, a capacitor and a resistive ground loss. The radiation efficiency of a dipole antenna system, assuming a single mode can be approximated by the following equation:

$$E = \frac{R_r}{(R_r + X_L + X_C + R_L)}$$

Where

E is the efficiency
$R_r$ is the radiation resistance
$X_L$ is the inductive reactance
$X_C$ is the capacitive reactance
$X_L$ is the ohmic feed point ground losses and skin effect The radiation resistance is a fictitious resistance that accounts for energy radiated by the antenna. The inductive reactance represents the inductance of the conductive dipole lines, while the capacitor is the capacitance between the conductors. The other series connected components simply turn RF energy into heat, which reduces the radiation efficiency of the dipole.

From the foregoing, it can be seen that the constraints of a circuit board substrate having selected relative dielectric properties often results in design compromises that can negatively affect the electrical performance and/or physical characteristics of the overall circuit. An inherent problem with the conventional approach is that, at least with respect to the substrate, the only control variable for line impedance is the relative permittivity. This limitation highlights an important problem with conventional substrate materials, i.e. they fail to take advantage of the other factor that determines characteristic impedance, namely $L_l$, the inductance per unit length of the transmission line.

Yet another problem that is encountered in RF circuit design is the optimization of circuit components for operation on different RF frequency bands. Line impedances and lengths that are optimized for a first RF frequency band may provide inferior performance when used for other bands, either due to impedance variations and/or variations in electrical length. Such limitations can limit the effective operational frequency range for a given RF system.

Conventional circuit board substrates are generally formed by processes such as casting or spray coating which generally result in uniform substrate physical properties, including the dielectric constant. Accordingly, conventional dielectric substrate arrangements for RF circuits have proven to be a limitation in designing circuits that are optimal in regards to both electrical and physical size characteristics.

SUMMARY OF THE INVENTION

The invention concerns a highly efficient antenna of reduced size. The antenna can be formed on a dielectric substrate including at least a first and second region. One or more antenna-radiating element is formed on the first region of the dielectric substrate and defines a conductive path. Feed circuitry for the antenna can be formed on the second region of the dielectric substrate. The feed circuitry can comprise a balun, an impedance transformer, and/or a feed line. The dielectric substrate in the first region can preferably have a first relative permeability and/or first permittivity different from a second relative permeability and/or a second permittivity of the dielectric substrate of the second region.

According to one aspect of the invention, the first relative permittivity or the first relative permeability can be smaller or larger in value as compared to the second relative permittivity and the second relative permeability, respectively. For example, the relative permeability value can be increased approximately as the square root of the relative permittivity for the purpose of improving efficiency. In any case, the first relative permeability provides improved radiation efficiency for the antenna-radiating element as compared to an antenna element formed on a conventional board substrate without regions of differentially modified permeability.

DETAILED DESCRIPTION OF THE PREFERRED EMBODIMENTS

Low dielectric constant board materials are ordinarily selected for RF designs. For example, polytetrafluoroethylene (PTFE) based composites such as RT/duroid® 6002 (dielectric constant of 2.94; loss tangent of 0.009) and RT/duroid® 5880 (dielectric constant of 2.2; loss tangent of 0.0007) are both available from Rogers Microwave Products, Advanced Circuit Materials Division, 100 S. Roosevelt Ave, Chandler, Ariz. 85226. Both of these materials are common board material choices. The above board materials provide dielectric layers having relatively low dielectric constants with accompanying low loss tangents.

However, use of conventional board materials can compromise the miniaturization of circuit elements and may also compromise some performance aspects of circuits that can benefit from high dielectric constant layers. A typical tradeoff in a communications circuit is between the physical size of antenna elements versus efficiency. By comparison, the present invention provides the circuit designer with an added level of flexibility by permitting use of a dielectric layer portion with selectively controlled permittivity and permeability properties optimized for efficiency. This added flexibility enables improved performance and antenna element density not otherwise possible.

Figure 1:
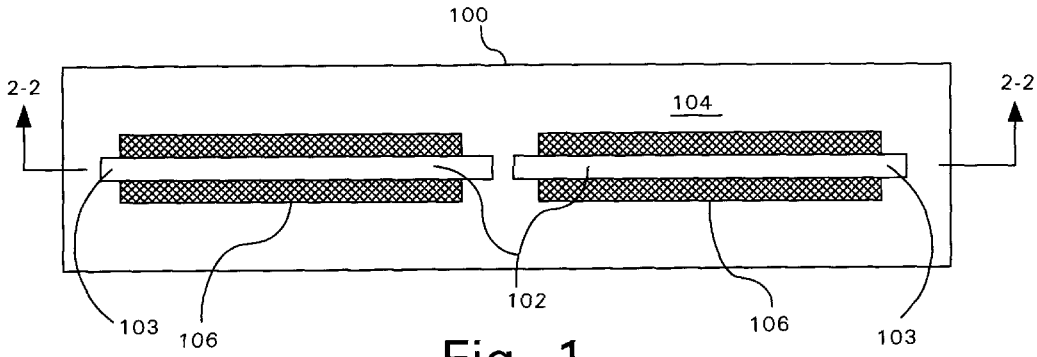
FIG. 1 is a top view of an antenna element formed on a substrate for reducing the size and improving the radiation efficiency of the element.
Figure 3:
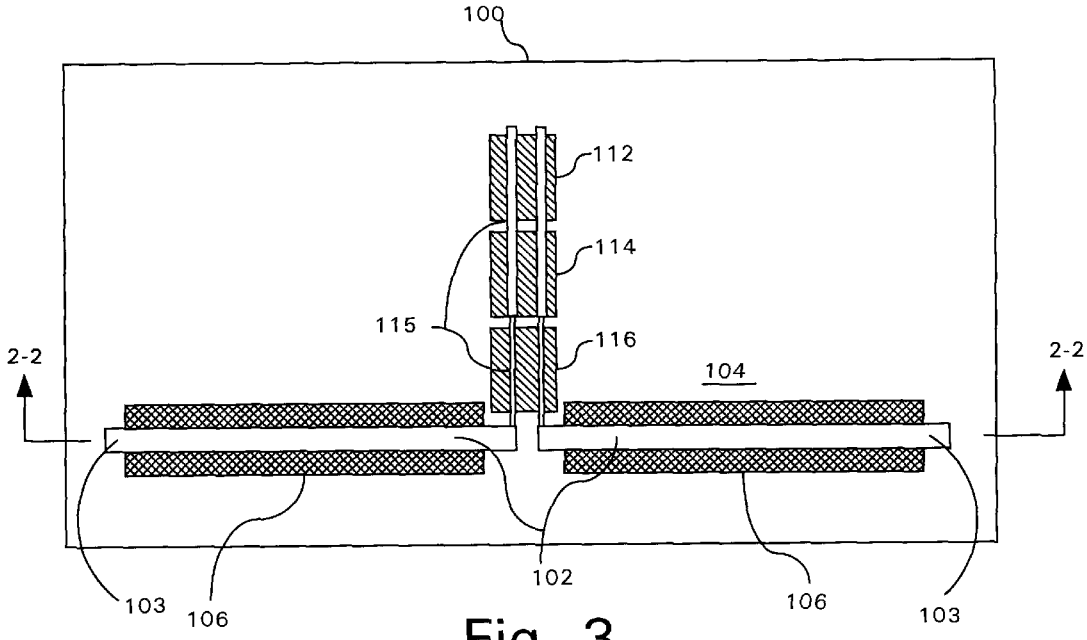
FIG. 3 is a top view of an alternative embodiment of the antenna element in FIG. 1 and associated feed line circuitry.

Referring to FIG. 1, antenna 102 can be comprised of elements 103. The elements 103 can be mounted on dielectric layer 100 as shown or, buried within the dielectric layer 100. In FIG. 1, the antenna 102 is configured as a dipole, but it will be appreciated by those skilled in the art that the invention is not so limited. According to a preferred embodiment, dielectric layer 100 includes first region 104 having a first relative permittivity, and a second region 106 having a second relative permittivity. The first relative permittivity can be different from the second relative permittivity, although the invention is not so limited. A ground plane 110 is preferably provided beneath the antenna 102 and can include openings for the passage of antenna feeds 108. Alternatively, the feed line for the antenna can be disposed directly on the surface of the substrate as shown in FIG. 3. Dielectric material 100 has a thickness that defines an antenna height above ground. The thickness is approximately equal to the physical distance from antenna 102 to the underlying ground plane 110.

Antenna elements 103 and the second region 106 of the dielectric layer are configured so that at least a portion of the antenna elements are positioned on the second region 106 as shown. According to a preferred embodiment, a substantial portion of each antenna element is positioned on the second region 106 as shown.

In order to reduce the physical size of the elements 103, the second relative permittivity of the substrate in the second region 106 can be substantially larger than the first relative permittivity of the dielectric in the first region 104. In general, resonant length is roughly proportional to $1/\sqrt{\in_r}$ where $\in_r$ is the relative permittivity. Accordingly, selecting a higher value of relative permittivity can reduce the physical dimensions of the antenna.

One problem with increasing the relative permittivity in second region 106 is that radiation efficiency of the antenna 102 can be reduced. Antennas printed on high dielectric constant and relatively thick substrates tend to exhibit poor radiation efficiency. With dielectric substrate having higher values of relative permittivity, a larger amount of the electromagnetic field is concentrated in the dielectric between the conductive antenna element and the ground plane. Poor radiation efficiency under such circumstances is often attributed in part to surface wave modes propagating along the air/substrate interface.

As the size of the antenna is reduced through use of a high dielectric substrate, the net antenna capacitance generally decreases because the area reduction more than offsets the increase in effective permittivity resulting from the use of a higher dielectric constant substrate portion.

The present invention permits formation of dielectric substrates having one or more regions having significant magnetic permeability. Prior substrates generally included materials having relative magnetic permeabilities of approximately 1. The ability to selectively add significant magnetic permeability to portions of the dielectric substrate can be used to increase the inductance of nearby conductive traces, such as transmission lines and antenna elements. This flexibility can be used to improve RF system performance in a number of ways.

For example, in the case of short dipole antennas, dielectric substrate portions having significant relative magnetic permeability can be used to increase the inductance of the dipole elements to compensate for losses in radiation efficiency from use of a high dielectric substrate and the generally resulting higher capacitance. Accordingly, resonance can be obtained, or approached, at a desired frequency by use of a dielectric having a relative magnetic permeability larger than 1. Thus, the invention can be used to improve performance or obviate the need to add a discrete inductor to the system in an attempt to accomplish the same function.

In general it has been found that as substrate permittivity increases from 1, it is desirable to also increase permeability in order for the antenna to more effectively transfer electromagnetic energy from the antenna structure into free space. In this regard, it may be noted that variation in the dielectric constant or permittivity mainly affects the electric field whereas control over the permeability improves the transfer of energy for the magnetic field.

For greater radiation efficiency, it has been found that the permeability can be increased roughly in accordance with the square root of the permittivity. For example, if a substrate were selected with a permittivity of 9, a good starting point for an optimal permeability would be 3. Of course, those skilled in the art will recognize that the optimal values in any particular case will be dependent upon a variety of factors including the precise nature of the dielectric structure above and below the antenna elements, the dielectric and conductive structure surrounding the antenna elements, the height of the antenna above the ground plane, width of the dipole arm, and so on. Accordingly, a suitable combination of optimum values for permittivity and permeability can be determined experimentally and/or with computer modeling.

Figure 2:
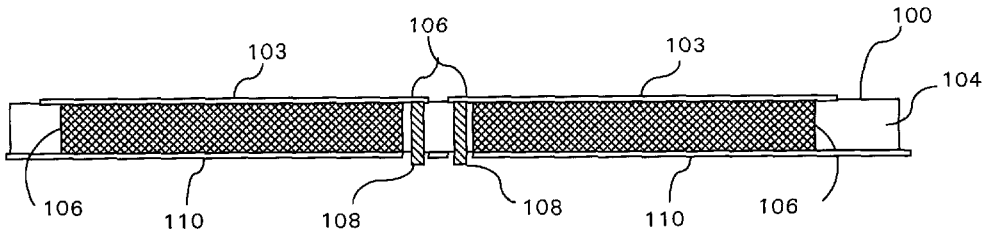
FIG. 2 is a cross-sectional view of an antenna element of FIG. 1 taken along line 2—2.

Those skilled in the art will recognize that the foregoing technique is not limited to use with microstrip antennas such as those shown in FIGS. 1 and 2. Instead, the foregoing technique can be used to produce efficient antenna elements of reduced size in other types of substrate structures. For example, rather than residing exclusively on top of the substrate as shown in FIGS. 1 and 2, the antenna elements 103 can be partially or entirely embedded within the second region 106 of the dielectric layer.

According to a preferred embodiment, the relative permittivity and/or permeability of the dielectric in the second region 106 can be different from the relative permittivity and permeability of the first region 104. Further, at least a portion of the dielectric substrate 100 can be comprised of one or more additional regions on which additional circuitry can be provided. For example, in FIG. 3, region 112, 114, 116 can support antenna feed circuitry 115, which can include a balun, a feed line or an impedance transformer. Each region 112, 114, 116 can have a relative permittivity and permeability that is optimized for the physical and electrical characteristics required for each of the respective components.

Figure 5:
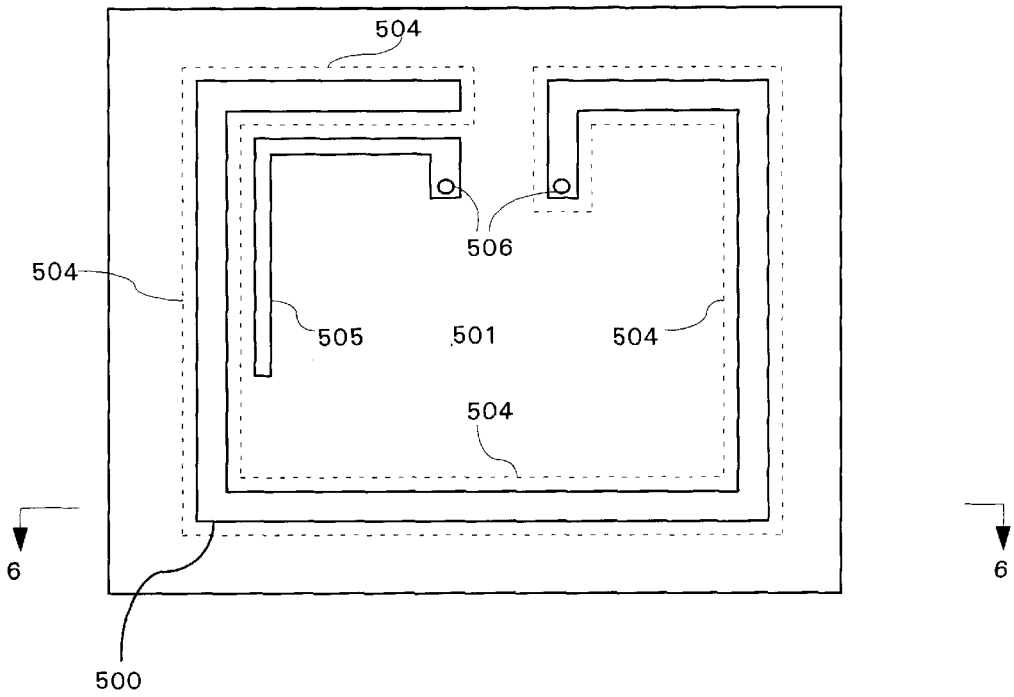
FIG. 5 is an alternative embodiment of the invention showing an loop configuration antenna.
Figure 6:
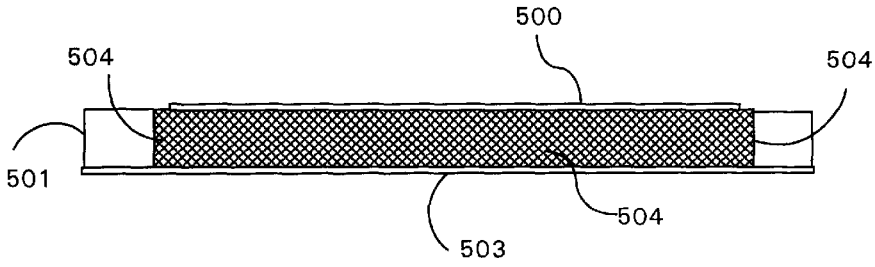
FIG. 6 is a cross-sectional view of FIG. 5 taken along line 6—6.

Likewise, these techniques can be used for any other type of substrate antennas, the dipole of FIG. 1 being merely one example. Another example is a loop antenna, as shown in FIGS. 5 and 6, in which the permittivity and permeability of the substrate beneath the radiating elements and/or feed circuitry is selectively controlled for reduced size with high radiation efficiency. In FIG. 5 a loop antenna element 500 having a feed point 506 and a matching balun 505 is shown mounted on a dielectric substrate 501. A ground plane 503 can be provided beneath the substrate as illustrated. According to a preferred embodiment, the dielectric substrate region 504 beneath the loop antenna element 500 can have a permittivity and permeability that is different from the surrounding substrate 501. For example, increased permittivity in region 504 can reduce the size of the antenna element 500 for a given operating frequency. In order to maintain satisfactory radiation efficiency however, the permeability in region 504 can be increased in a manner similar to that described above with respect to the dipole antenna in FIG. 1.

Figure 4:
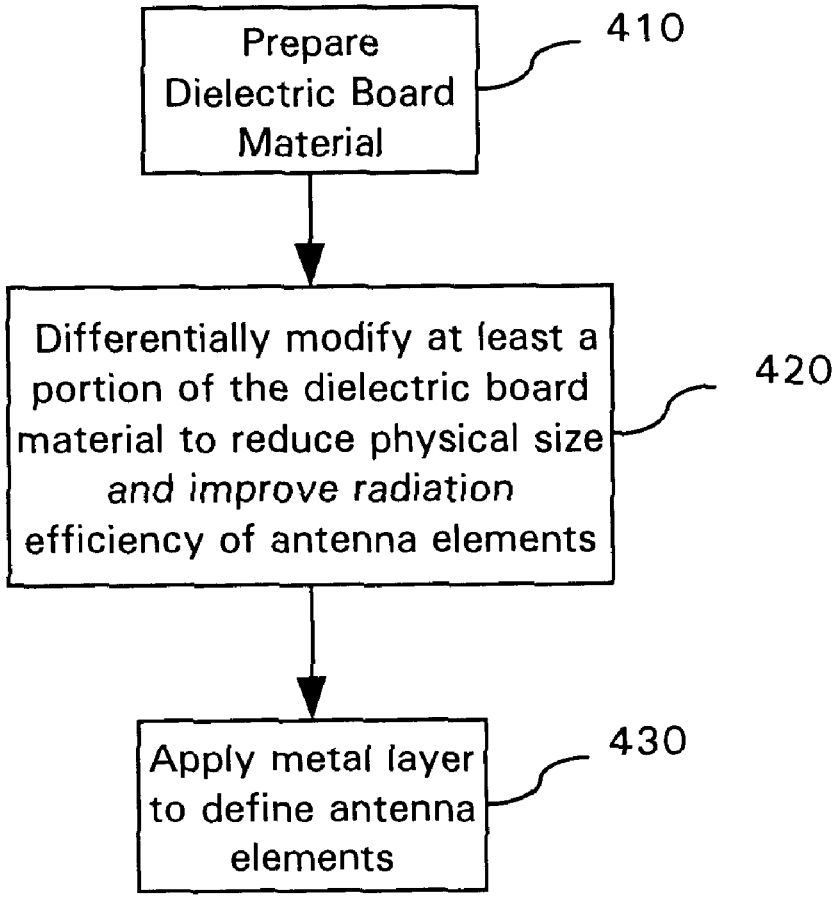
FIG. 4 is a flow chart that is useful for illustrating a process for manufacturing an antenna of reduced physical size and high radiation efficiency.

Dielectric substrate boards having metamaterial portions providing localized and selectable magnetic and dielectric properties can be prepared as shown in FIG. 4. In step 410, the dielectric board material can be prepared. In step 420, at least a portion of the dielectric board material can be differentially modified using metamaterials, as described below, to reduce the physical size and achieve the best possible efficiency for the antenna elements and associated feed circuitry. Finally, a metal layer can be applied to define the conductive traces associated with the antenna elements and associated feed circuitry.

As defined herein, the term "meta-materials" refers to composite materials formed from the mixing or arrangement of two or more different materials at a very fine level, such as the Angstrom or nanometer level. Metamaterials allow tailoring of electromagnetic properties of the composite, which can be defined by effective electromagnetic parameters comprising effective electrical permittivity (or dielectric constant) and the effective magnetic permeability.

The process for preparing and differentially modifying the dielectric board material as described in steps 410 and 420 shall now be described in some detail. It should be understood, however, that the methods described herein are merely examples and the invention is not intended to be so limited.

Appropriate bulk dielectric substrate materials can be obtained from commercial materials manufacturers, such as DuPont and Ferro. The unprocessed material, commonly called Green Tape™, can be cut into sized portions from a bulk dielectric tape, such as into 6 inch by 6 inch portions. For example, DuPont Microcircuit Materials provides Green Tape material systems, such as Low-Temperature Cofire Dielectric Tape. These substrate materials can be used to provide dielectric layers having relatively moderate dielectric constants with accompanying relatively low loss tangents for circuit operation at microwave frequencies once fired.

In the process of creating a microwave circuit using multiple sheets of dielectric substrate material, features such as vias, voids, holes, or cavities can be punched through one or more layers of tape. Voids can be defined using mechanical means (e.g. punch) or directed energy means (e.g., laser drilling, photolithography), but voids can also be defined using any other suitable method. Some vias can reach through the entire thickness of the sized substrate, while some voids can reach only through varying portions of the substrate thickness.

The vias can then be filled with metal or other dielectric or magnetic materials, or mixtures thereof, usually using stencils for precise placement. The individual layers of tape can be stacked together in a conventional process to produce a complete, multi-layer substrate.

The choice of a metamaterial composition can provide tunable effective dielectric constants over a relatively continuous range from less than 2 to about 2650. Materials with magnetic properties are also available. For example, through choice of suitable materials the relative effective magnetic permeability generally can range from about 4 to 116 for most practical RF applications. However, the relative effective magnetic permeability can be as low as about 2 or reach into the thousands.

The term "differentially modified" as used herein refers to modifications, including dopants, to a dielectric substrate layer that result in at least one of the dielectric and magnetic properties being different at one portion of the substrate as compared to another portion. A differentially modified board substrate preferably includes one or more metamaterial containing regions.

For example, the modification can be selective modification where certain dielectric layer portions are modified to produce a first set of dielectric or magnetic properties, while other dielectric layer portions are modified differentially or left unmodified to provide dielectric and/or magnetic properties different from the first set of properties. Differential modification can be accomplished in a variety of different ways.

According to one embodiment, a supplemental dielectric layer can be added to the dielectric layer. Techniques known in the art such as various spray technologies, spin-on technologies, various deposition technologies or sputtering can be used to apply the supplemental dielectric layer. The supplemental dielectric layer can be selectively added in localized regions, including inside voids or holes, or over the entire existing dielectric layer. For example, a supplemental dielectric layer can be used for providing a substrate portion having an increased effective dielectric constant.

The differential modifying step can further include locally adding additional material to the dielectric layer or supplemental dielectric layer. The addition of material can be used to further control the effective dielectric constant or magnetic properties of the dielectric layer to achieve a given design objective.

The additional material can include a plurality of metallic and/or ceramic particles. Metal particles preferably include iron, tungsten, cobalt, vanadium, manganese, certain rare-earth metals, nickel or niobium particles. The particles are preferably nanometer size particles, generally having sub-micron physical dimensions, hereafter referred to as nanoparticles.

The particles, such as nanoparticles, can preferably be organofunctionalized composite particles. For example, organofunctionalized composite particles can include particles having metallic cores with electrically insulating coatings or electrically insulating cores with a metallic coating.

Magnetic metamaterial particles that are generally suitable for controlling magnetic properties of dielectric layer for a variety of applications described herein include ferrite organoceramics (FexCyHz)-(Ca/Sr/Ba-Ceramic). These particles work well for applications in the frequency range of 8–40 GHz. Alternatively, or in addition thereto, niobium organoceramics (NbCyHz)-(Ca/Sr/Ba-Ceramic) are useful for the frequency range of 12–40 GHz. The materials designated for high frequency are also applicable to low frequency applications. These and other types of composite particles can be obtained commercially.

In general, coated particles are preferable for use with the present invention as they can aid in binding with a polymer (e.g. LCP) matrix or side chain moiety. In addition to controlling the magnetic properties of the dielectric, the added particles can also be used to control the effective dielectric constant of the material. Using a fill ratio of composite particles from approximately 1 to 70%, it is possible to raise and possibly lower the dielectric constant of substrate dielectric layer and/or supplemental dielectric layer portions significantly. For example, adding organofunctionalized nanoparticles to a dielectric layer can be used to raise the dielectric constant of the modified dielectric layer portions.

Particles can be applied by a variety of techniques including polyblending, mixing and filling with agitation. For example, if the dielectric layer includes a LCP, the dielectric constant may be raised from a nominal LCP value of 2 to as high as 10 by using a variety of particles with a fill ratio of up to about 70%.

Metal oxides useful for this purpose can include aluminum oxide, calcium oxide, magnesium oxide, nickel oxide, zirconium oxide and niobium (II, IV and V) oxide. Lithium niobate ($LiNbO_3$), and zirconates, such as calcium zirconate and magnesium zirconate, also may be used.

The selectable dielectric properties can be localized to areas as small as about 10 nanometers, or cover large area regions, including the entire board substrate surface. Conventional techniques such as lithography and etching along with deposition processing can be used for localized dielectric and magnetic property manipulation.

Materials can be prepared mixed with other materials or including varying densities of voided regions (which generally introduce air) to produce effective dielectric constants in a substantially continuous range from 2 to about 2650, as well as other potentially desired substrate properties. For example, materials exhibiting a low dielectric constant (<2 to about 4) include silica with varying densities of voided regions. Alumina with varying densities of voided regions can provide a dielectric constant of about 4 to 9. Neither silica nor alumina have any significant magnetic permeability. However, magnetic particles can be added, such as up to 20 wt. %, to render these or any other material significantly magnetic. For example, magnetic properties may be tailored with organofunctionality. The impact on dielectric constant from adding magnetic materials generally results in an increase in the dielectric constant.

Medium dielectric constant materials have a dielectric constant generally in the range of 70 to 500+/−10%. As noted above these materials may be mixed with other materials or voids to provide desired effective dielectric constant values. These materials can include ferrite doped calcium titanate. Doping metals can include magnesium, strontium and niobium. These materials have a range of 45 to 600 in relative magnetic permeability.

For high dielectric constant applications, ferrite or niobium doped calcium or barium titanate zirconates can be used. These materials have a dielectric constant of about 2200 to 2650. Doping percentages for these materials are generally from about 1 to 10%. As noted with respect to other materials, these materials may be mixed with other materials or voids to provide desired effective dielectric constant values.

These materials can generally be modified through various molecular modification processing. Modification processing can include void creation followed by filling with materials such as carbon and fluorine based organo functional materials, such as polytetrafluoroethylene PTFE.

Alternatively or in addition to organofunctional integration, processing can include solid freeform fabrication (SFF), photo, uv, x-ray, e-beam or ion-beam irradiation. Lithography can also be performed using photo, uv, x-ray, e-beam or ion-beam radiation.

Different materials, including metamaterials, can be applied to different areas, so that a plurality of areas of the substrate layers have different dielectric and/or magnetic properties. The backfill materials, such as noted above, may be used in conjunction with one or more additional processing steps to attain desired, dielectric and/or magnetic properties, either locally or over a bulk substrate portion.

A top layer conductor print is then generally applied to the modified substrate layer. Conductor traces can be provided using thin film techniques, thick film techniques, electroplating or any other suitable technique. The processes used to define the conductor pattern include, but are not limited to standard lithography and stencil.

A base plate is then generally obtained for collating and aligning a plurality of modified board substrates. The plurality of layers of substrate can then be laminated (e.g. mechanically pressed) together using either isostatic pressure, which puts pressure on the material from all directions, or uniaxial pressure, which puts pressure on the material from only one direction. The laminate substrate is then is further processed as described above or placed into an oven to be fired to a temperature suitable for the processed substrate (approximately 850 C to 900 C for the materials cited above).

The plurality of ceramic tape layers can then be fired, using a suitable furnace that can be controlled to rise in temperature at a rate suitable for the substrate materials used. The process conditions used, such as the rate of increase in temperature, final temperature, cool down profile, and any necessary holds, are selected mindful of the substrate material and any material deposited thereon. Following firing, stacked substrate boards, typically, are inspected for flaws using an optical microscope.

The stacked ceramic substrates can then be optionally diced into cingulated pieces as small as required to meet circuit functional requirements. Following final inspection, the cingulated substrate pieces can then be mounted to a test fixture for evaluation of their various characteristics, such as to assure that the dielectric, magnetic and/or electrical characteristics are within specified limits.

Thus, dielectric substrate materials can be provided with locally selected dielectric and/or magnetic characteristics for improving the density and performance of circuits. The dielectric flexibility allows independent optimization of the feed line impedance and dipole antenna elements.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

What is claimed is:

1. A highly efficient reduced size antenna, comprising:

a dielectric substrate including at least a first and second region;

at least one antenna radiating element selectively formed on at least a portion of said first region of said dielectric substrate and defining a conductive path;

said dielectric substrate in said first region having a first relative permeability and first relative permittivity different respectively from a second relative permeability and a second relative permittivity of said dielectric substrate of said second region.

2. The antenna according to claim 1 wherein at least one of said first relative permittivity and said first relative permeability are larger in value as compared to said second relative permittivity and said second relative permeability, respectively.

3. The antenna according to claim 1 further comprising feed circuitry for said at least one antenna radiating element, said feed circuitry formed on said second region of said dielectric substrate.

4. The antenna according to claim 3 wherein at least one of said first relative permittivity and said first relative permeability are smaller in value as compared to said second relative permittivity and said second relative permeability, respectively.

5. The antenna according to claim 3 wherein said feed circuitry comprises at least one of a balun, an impedance transformer, and a feed line.

6. The antenna according to claim 1 wherein said first relative permeability provides an improved radiation efficiency for said antenna radiating element.

7. The antenna according to claim 1 wherein said dielectric material in at least one of said first or second regions is modified by the addition of particles to said dielectric substrate.

8. The antenna according to claim 7 wherein said particles are nanometer sized particles.

9. The antenna according to claim 1 wherein said relative permeability of at least one of said first and second regions are controlled by the addition of magnetic meta-materials to said dielectric substrate.

10. The antenna according to claim 1, wherein said relative permeability value is approximately the square root of the relative permittivity.

11. The antenna according to claim 1 comprising a pair of radiating elements defining a dipole configuration.

12. The antenna according to claim 1 wherein said at least one radiating element is configured as a loop antenna.

13. A highly efficient antenna of reduced size, comprising:

dielectric substrate including at least a first and second region;

at least one antenna radiating element selectively formed on said first region of said dielectric substrate and defining a conductive path;

feed circuitry for said at least one antenna formed on said second region of said dielectric substrate;

said dielectric substrate in said first region having a first relative permeability and first relative permittivity different from a second relative permeability and a second relative permittivity of said dielectric substrate of said second region.

14. The antenna according to claim 13 wherein at least one of said first relative permittivity and said first relative permeability are smaller in value as compared to said second relative permittivity and said second relative permeability, respectively.

15. The antenna according to claim 13 wherein said feed circuitry comprises at least one of a balun, an impedance transformer, and a feed line.

16. The antenna according to claim 13 wherein said first relative permeability provides an improved radiation efficiency for said antenna radiating element.

17. The antenna according to claim 13 wherein said dielectric material in at least one of said first or second regions is modified by the addition of particles to said dielectric substrate.

18. The antenna according to claim 17 wherein said particles are nanometer sized particles.

19. The antenna according to claim 13 wherein said relative permeability of at least one of said first and second regions are controlled by the addition of magnetic meta-materials to said dielectric substrate.

20. The antenna according to claim 13, wherein said first relative permeability value is approximately the square root of the first relative permittivity.

21. A highly efficient reduced size antenna, comprising:

a dielectric substrate including at least a first and second region, said dielectric substrate in said first region having a first relative permeability and first relative permittivity different respectively from a second relative permeability and a second relative permittivity of said dielectric substrate of said second region;

at least one antenna radiating element selectively formed on at least a portion of said first region of said dielectric substrate and defining a conductive path; and feed circuitry for said at least one antenna radiating element, said feed circuitry formed on said second region of said dielectric substrate.

22. The antenna according to claim 21 wherein at least one of said first relative permittivity and said first relative permeability are smaller in value as compared to said second relative permittivity and said second relative permeability, respectively.

23. The antenna according to claim 21 wherein said feed circuitry comprises at least one of a balun, an impedance transformer, and a feed line.

24. A highly efficient reduced size antenna, comprising:

a dielectric substrate including at least a first and second region, said dielectric substrate in said first region having a first relative permeability and first relative permittivity different respectively from a second relative permeability and a second relative permittivity of said dielectric substrate of said second region; and at least one antenna radiating element selectively formed on at least a portion of said first region of said dielectric substrate and defining a conductive path, wherein said relative permeability of at least one of said first and second regions are controlled by the addition of magnetic meta-materials to said dielectric substrate.

25. A highly efficient reduced size antenna, comprising:

a dielectric substrate including at least a first and second region, said dielectric substrate in said first region having a first relative permeability and first relative permittivity different respectively from a second relative permeability and a second relative permittivity of said dielectric substrate of said second region; and at least one antenna radiating element selectively formed on at least a portion of said first region of said dielectric substrate and defining a conductive path;

wherein at least one of said first and second relative permeability values is respectively equal to approximately the square root of at least one of said first and second relative permittivities.

* * * * *